US006774329B2

(12) United States Patent
Shimizu et al.

(10) Patent No.: US 6,774,329 B2
(45) Date of Patent: Aug. 10, 2004

(54) SWITCH DEVICE

(75) Inventors: Keiichi Shimizu, Kasugai (JP); Yasuhide Tanaka, Owariasahi (JP); Tetsuhiko Miyoshi, Tottori (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/691,437

(22) Filed: Oct. 8, 2003

(65) Prior Publication Data

US 2004/0112731 A1 Jun. 17, 2004

(30) Foreign Application Priority Data

Oct. 11, 2002 (JP) ..... 2002/299275

(51) Int. Cl.[7] ..... H01H 3/00
(52) U.S. Cl. ..... 200/339; 200/553; 200/329
(58) Field of Search ..... 200/339, 5 A, 200/5 R, 553, 329, 557

(56) References Cited

U.S. PATENT DOCUMENTS 5,285,039 A * 2/1994 Satoh ..... 200/563
5,446,253 A * 8/1995 Oshgan ..... 200/556
5,770,825 A * 6/1998 Yamaguchi et al. ..... 200/5 R
5,805,402 A * 9/1998 Maue et al. ..... 361/93.1
5,902,972 A * 5/1999 Nestor et al. ..... 200/1 B
6,005,201 A * 12/1999 Tanaka et al. ..... 200/16 C
6,054,655 A * 4/2000 Rudolph et al. ..... 200/16 R
6,239,392 B1 * 5/2001 Serizawa et al. ..... 200/5 R

FOREIGN PATENT DOCUMENTS

JP 2001-202863 7/2001 ..... H01H/50/56

* cited by examiner

*Primary Examiner*—Lincoln Donovan
*Assistant Examiner*—K. Lee
(74) *Attorney, Agent, or Firm*—Osha & May L.L.P.

(57) ABSTRACT

A switch unit is provided which is free from causing contact damage even in case applied to a high power voltage, whose switch unit is not greatly increased in size. Switches A and B are to take a motor stop status, a motor forward rotation status and a motor reverse rotation status. A switch C is to electrically connecting and disconnecting between the switches A and B and the power source. This switch C, when the switches A and B transits from the motor forward rotation status or motor reverse rotation status into the motor stop status, is operated from a connection state to a disconnection state at a time of any of completing the transition to the motor stop status and prior to a predetermined marginal period of time.

2 Claims, 13 Drawing Sheets

L DIRECTION
R DIRECTION
NEUTRAL
NEUTRAL
NEUTRAL
NEUTRAL
SLIDER 41
A3-A4 CLOSE
A1-A2 CLOSE
A1-A2 CLOSE
SWITCH A
B3-B4 CLOSE
B1-B2 CLOSE
B1-B2 CLOSE
SWITCH B
C1-C2 CLOSE
C1-C2 CLOSE
C1-C2 OPEN
C1-C2 OPEN
C1-C2 OPEN
SWITCH C
DIRECT-CURRENT MOTOR 2
STOP
UP
STOP
DOWN
STOP
Td1
Td2
Td3
Td4

SWITCH DEVICE

BACKGROUND OF THE INVENTION

1. Technical Field of the Invention

The present invention relates to a switch device for rotating and stopping a window-opening/closing direct-current motor for a vehicle such as an automobile or a direct-current motor in the similar application, and more particularly to a switch device suitably applicable to a direct-current motor to operate on high power voltage (e.g. 42V-based electrical system).

2. Description of the Related Art

The 14V-based electric systems are employed on the existing automobiles. However, the 14V-based system in the recent situation cannot afford to supply consuming power because of the increasing number of mounting electronic apparatuses and devices. In an attempt to eliminate this, discussions have been continued globally in the forms of industry-university consortiums and the like. As a result, a consensus has been gained by adopting a treble high-voltage system, or "42V-based" electrical system, wherein the safety to the human body is taken into account.

The electrical devices operable on 42V-based electrical system include a window operating/closing direct-current motor built within the door (so-called a power-window driving direct-current motor), for example.

FIG. 8A is a structural view of a conventional switch device for rotating (forward/reverse) and stopping a window-opening/closing direct-current motor while FIG. 8B is a circuit diagram of the same (see Non-patent Document 1, for example).

This switch device 1 is arranged on an armrest or the like provided on an interior side of the door at the vehicular front or rear seat. The switch device 1 of the figure is shown a state that the power-window driving direct-current motor (hereinafter referred to as "direct-current motor) 2 is in a standstill. Namely, shown is the state that the knob 3 is not operated by a vehicular passenger. Hereinafter, this state is referred to as a "neutral state".

The knob 3 is arranged on a case 4 on the door side, for rotation by a predetermined angle in a clockwise and counter clockwise direction of the figure. When the knob 3 is moved clockwise, the window closes (hereinafter referred to as "UP state"). When it is moved counter clockwise, the window opens (hereinafter referred to as "DOWN state"). In case the operating force applied to the knob 3 is canceled (releasing the finger), it returns to the neutral state by the action of the spring 5 and plunger 6 buried within the knob 3, maintaining the neutral state from then on.

The lower projection 7 of knob 3 extending within the case 4 assumes the shown position when the knob 3 is in the neutral state. When the knob 3 is placed in the UP state, it swings leftward of the figure (see FIG. 10A). When the knob 3 is placed in the DOWN state, it swings rightward of the figure (not shown).

Within the case 4, there is provided a switch unit 9 mounted on a printed board 8. This switch unit 9 is to function as a "2-circuit 2 contact" switch of a momentary type, the exterior view of which is shown in FIGS. 9A to 9D. The switch 9 has two common terminals 11, 12 extended from one side surface of the housing 10, one normally-open terminal 13 extended from the other side surface of the housing 10, and two normally-close terminals 14, 15 extended from the bottom surface of the housing 10. These terminals 11–15 are soldered on a required conductor circuit formed on the printed board 8, and connected to a power line (hereinafter referred to as "+B line") 17, a ground line 18 and the direct-current motor 2. Thus, the configuration of a circuit diagram of FIG. 8B is realized.

Within the switch unit 9, two circuits of switches A, B are mounted as shown in FIG. 8B. These switches A, B is exclusively switched over depending upon a slide position of the slider 28 arranged on an upper surface of the switch unit 9. Incidentally, "exclusively switched over" means that the NC (normally-close) contact of one of the switches A and B only is put in an open state (in other words, the NO (normally-open) contact of that switch only is put in a close state).

Specifically, when the slider 28 is in the position of the figure (in the "neutral state"), the switch A is in a close state at between a movable contact 19 and an NC contact 23 while the switch B is at between a movable contact 20 and an NC contact 24. In this state, the switches A, B assume states as per the names (NO→normally open, NC→normally close) at NO contacts 21, 22 and NC contacts 23, 24 in two sets. However, when the slider 28 moves in a direction of the leftward arrow L in FIG. 9A (in the "UP state"), the switch B is maintained in the close state at between movable contact 20 and NC contact 24. Furthermore, the switch A is canceled of the close state at NC contact 23, into newly a close state at between movable contact 19 and NO contact 21. Meanwhile, when the slider 28 moves in a direction of the rightward arrow R in FIG. 9A (in the "DOWN state"), the switch A is maintained in the close state at between movable contact 19 and NC contact 24. Furthermore, the switch B is canceled of the close state at NC contact 24, into newly a close state at between movable contact 20 and NO contact 22.

The switching action like this is caused by movement of the slider 28 and an underside geometry of the slider 28. FIG. 9C is an X—X sectional view of the slider 28 while FIG. 9D is a Y—Y sectional view of the slider 28. The slider 28 in the X—X section is formed thick-walled in the right half thereof while the slider 28 in the Y—Y section is formed thick-walled in the left half thereof. As will be apparent from the below explanation, the switches A and B are exclusively switched over depending upon a positional relationship of the thick-walled part.

Incidentally, FIG. 8A depicts only one of the common terminals 11, 12 and one of the normally-close terminals 14, 15. This is because the terminals are arranged front and rear on the figure, wherein the terminal on the rear is hidden invisible by the front terminal.

As explained before, the switch unit 9 functions as a "2-circuit 2-contact" switch of a momentary type. Namely, the movable contacts 19, 20, the NO contacts 21, 22 and the NC contacts 23, 24 are respectively connected to the common terminals 11, 12, the normally-open terminals 13 and the normally-close terminals 14, 15, thereby exclusively enabling contact-switching of two circuit 5 (switching between the movable contact 19, the NO contact 21 and the NC contact 23, and switching between the movable contact 20, the NO contact 22 and the NC contact 24).

The movable contact 19, 20 is attached on a tip of a metal-make spring leaf movable piece 25, 26. The metal-make spring leaf movable piece 25, 26 is made to be urged downward in the figure by a push button 27A, 27B (the push button 27A is for the switch A, the push button 27B is for the switch B). The push button 27A, 27B is in abutment against an underside of the slider 28 (see FIGS. 9A to 9D) movable laterally in the figure. As shown in FIG. 10A, as slider 28 moves left in the figure, the push button 27A only can be separately pressed down along the underside geometry (thick-walled part) of the slider 28. Meanwhile, the upper projection 29 of the slider 28 is engaged with the tip of a lower projection of the knob 3. The slider 28 follows the lower projection 7 of knob 3 swinging left and right (UP and DOWN states), to slide in the left and right direction in the figure.

Accordingly, in the switch device 1, when the knob 3 is pulled up into the UP state, the slider 28 slides leftward. The push button 27A, abutting against the thick-walled part of slider 28 with respect to its X—X section, moves down. The switch A is placed into an open state at its movable contact 19 and NC contact 23, while the same switch A is placed in a close state at its movable contact 19 and NO contact 21, which operation is thus obtained. Meanwhile, when the knob 3 is released from the finger into a neutral state, the slider 28 slides rightward and returns to the former position. The push button 27A moves up to place the switch A into a close state at its movable contact 19 and NC contact 23, which operation is thus obtained Furthermore, when the knob 3 is pressed down into the DOWN state, the slider 28 slides rightward. The push button 27B, abutting against the thick-walled part of slider 28 with respect to its Y—Y section, moves down. The switch B is placed into an open state at its movable contact 20 and NC contact 24, while the same switch B is placed in a close state at its movable contact 20 and NO contact 22, which operation is thus obtained. Meanwhile, when the knob 3 is released from the finger into a neutral state, the slider 28 slides leftward and returns to the former position. The push button 27B moves up, to place the switch B into a close state at its movable contact 20 and NC contact 24, which operation in then obtained.

In the circuit diagram of FIG. 8B, when the knob 3 is in the neutral state, the respective contacts of the switches A and B are in the state shown in the figure, Namely, the switch A is in a close state at between the movable contact 19 and the NC contact 23 while the switch B is in a close state at between the movable contact 20 and the NC contact 24. In this state, because the direct-current motor 2 and the +B line 17 are out of connection and further the potential on ground line 11 (negative power) is applied to both two drive inputs of the direct-current motor 2, the direct-current motor 2 is in a standstill state of rotation. This standstill state of rotation corresponds to the "motor stop status" described in the gist of the invention.

Meanwhile, in the circuit diagram of FIG. 10B, when the knob 3 is in the UP state, the contacts of the switches A, B are in the state shown in the figure. Namely, the switch A is in a close state at between the movable contact 19 and NO contact 21 while the switch B is in a close state at the movable contact 20 and NC contact 24. In this state, because formed is a close circuit of +B line 17, NO contact 21→direct-current motor 2→NC contact 24→ground line 18, the direct-current motor 2 rotates in a direction closing the window. Provided that the rotation direction is forward, this state of rotation corresponds to "motor forward rotation status" described in the gist of the invention.

Meanwhile, although not shown, when the knob 3 is in the DOWN state, the switch A is in a close state at between the movable contact 19 and NC contact 23 while the switch B is in a close state at between the movable contact 20 and NO contact 22. In this state, because formed is a reverse rotation close circuit of +B line 17, NO contact 22→direct-current motor 2 NC contact 23→ground line 18, the direct-current motor 2 rotates in a direction opening the window. Provided that the rotation direction is reverse, this state of rotation corresponds to "motor reverse rotation status" described in the gist of the invention.

Accordingly, the switches A and B of the switch unit 9 in unison are to take a "motor stop status" to apply negative power (potential on the ground line 18) to both of one drive input and the other drive input of the direct-current motor 2 thereby placing the direct-current motor 2 in a stop state, a "motor forward rotation status" to apply positive power (potential on the +B line 17) to one drive input of the direct-current motor 2 and negative power (potential on the ground line 18) to the other drive input thereby placing the direct-current motor 2 in a forward rotation state, and a "motor reverse rotation status" to apply negative power (potential on the ground line 18) to one drive input of the direct-current motor 2 and positive power (potential on the +B line 17) to the other drive input thereby placing the direct-current motor 2 in a reverse rotation state, thus corresponding to "fist switch means" described in the gist of the invention.

Incidentally, although the above explanation showed the example that the one switch unit 9 controls the rotation of the direct-current motor 2, this is not limited to, i.e. on a certain vehicle, there is a switch for making, at the driver's seat, an open and close operation of the window of another seat (assistant driver's seat or rear seat).

FIG. 11 is a circuit diagram of the same (see Non-patent Document 1, for example). This circuit is configured by a combination of a driver's seat switch unit 9 and another seat switch unit 9'. A direct-current motor 2 (direct-current motor for opening/closing an other-seat window) can be rotated and stopped from the driver's seat besides, of course, from another seat.

Meanwhile, although the above explanation assigned one terminals (common terminals 11, 12 and normally-close terminals 14, 15) respectively to movable contacts 19, 20 and NC contacts 23, 24 while assigning one terminals (normally-open terminals 13) respectively to NO contacts 21, 22 (namely, totally five terminals are provided), this is not limited to. For example, as shown in FIG. 12, it may be a type that the contacts (NC contacts 23, 24 of switches A, B) connected to the ground line 18 are connected together within the unit, and extended from one terminal 15*a* and connected to the ground line 18 (totally four terminals are provided). Besides, the switch mechanism may be configured by the provision of one circuit, which is arranged two in usage. In this case, totally six terminals are included.

[Non-patent Document 1]

"Toyota*VITZ*Wiring Diagrams/SCP10 System (1999-1 to)" Toyota Automobile Co., Ltd. Service Department, issued Jan. 13, 1999. p. 3–38 to 3–39.

The switch device (FIGS. 8A, 8B, 9A–9D, 10A, 10B, and 11, and 12) in the prior art explained above operates freely from trouble as long as it is applied to the ordinary 14V-based electrical system. However, where it is applied to an electric system based on the higher voltage, e.g. 42V-based electrical system, a great current possibly flow through the contact connected to the negative power source during returning from the UP state to the neutral state or returning from the DOWN state to the neutral state. There is a problem that this current might cause damage to the relevant contact.

FIGS. 13A to 13C are explanatory diagrams on contact damage, wherein FIG. 13A is a diagram for example in the UP state, FIG. 13B is a diagram of "immediately before" returning to the neutral state, and FIG. 13C is a diagram of returned to the neutral state. The difference from the explanation of the prior art lies in that a high voltage (power voltage to 42V-based electrical system, hereinafter as "42V") is applied to the +B line 17.

In the meanwhile, an shown in FIG. 13A, when in the UP state, the switch A 18 in a close state at its NO contact 21 and movable contact 19 while the switch B is in a close state at its movable contact 20 and NC contact 24. Consequently, formed is a close circuit of +B line 17→direct-current motor 2→ground line 18. Thus, the direct-current motor 2 rotate in a direction closing the window.

Then, when the finger is released from the knob 3, the switch A is canceled of the close state at the NO contact 21 and movable contact 19, as shown in FIG. 13B. The movable contact 19 begins to move toward the NC contact 23 while causing an arc discharge 30 having a small allowable range to the NO contact 21.

Finally, as shown in FIG. 13C, the switch A goes into a close state at between the movable contact 19 and the NC contact 23, to cut off the power voltage to the direct-current motor 2. Thus, the direct-current motor 2 is placed in a stop state.

In the case the conventional switch unit 9 is used, the contact gap is as small as approximately 0.5 mm not to secure an arc discharge voltage of 42V, resulting in a connection to the NC contact 23 of the movable contact 19 in a state a several-volt voltage is applied. The experiment conducted by the present inventors has found a trouble that, because at this time a great current 31 (greater than 100A) is to flow in a brief time (approximately 0.5 ms) from the movable contact 19 to the ground line 18 through the NC contact 23, there occurs great discharge phenomenon (hereinafter referred to as "dead-short) 32 at between the NO contact 21 and the NC contact 23, thereby causing a damage (contact damage or breakdown) to the movable contact 19 and NC contact 23 of the switch A. Such Dead-short 32 is likely to take place particularly in the domain of a contact opening/closing rate (greater than 1000 mm/s) much faster than the ordinary contact opening/closing rate (100 to 400 mm/s).

Because the existence of such trouble prevents against the widespread of 42V-based electrical systems, there is a technical problem to be swiftly resolved in that respect.

Incidentally, as the general countermeasure against arc discharge, it is a practice to broaden the contact gap correspondingly to a magnitude of power voltage. This is because broadening the contact gap (e.g. approximately 4 mm) enables to increase arc discharge voltage so that the movable contact 19 in a state free of voltage application can be connected to the NC contact 23 to thereby avoiding against contact damage. However, this countermeasure, on one hand, involves a problem to incur a great size increase of the switch unit thus preventing against on-vehicle mounting.

Therefore, it is an object of the present invention to provide a switch device capable of avoiding contact damage without incurring a great size increase of a switch unit even where applied to a high power voltage such as a 42V-based electrical system.

SUMMARY OF THE INVENTION

The switch device according to the present invention is in a switch device having first switch means capable of taking a motor stop status for applying a negative power to each of one drive input and the other drive input of a direct-current motor thereby placing the direct-current motor in a stop state, a motor forward rotation status for applying a positive power to one drive input of the direct-current motor and a negative power to the other drive input thereof thereby placing the direct-current motor in a forward rotation state, and a motor reverse rotation status for applying a negative power to one drive input of the direct-current motor and a positive power to the other drive input thereof thereby placing the direct-current motor in a reverse rotation state, the switch device comprising:

second switch means for electrically connecting and disconnecting any of between the first switch means and one of the positive power and negative power and between the first switch means and one of one drive input and the other drive input of the direct current motor; and switch operating means for operating, upon transition of the first switch means from one of the motor forward rotation status and the motor reverse rotation status to the motor stop status, the second switch means from a connection state to a disconnection state at a time of any of completing the transition to the motor stop status and prior to a predetermined marginal period of time.

In this invention, the second switch means is operated from a connection state to a disconnection state at a time of any of completing the transition to the motor stop status and prior to a predetermined marginal period of time. Accordingly, during disconnection in the second switch means, electrical connection is cut off at any of between the first switch means and one of the positive power source and the negative power source and between the first switch means and one of one drive input of the direct-current motor and the other drive input thereof. Accordingly, the first switch means is reduced of the remaining voltage at the contact thereof, thereby eliminating the dead-short problem from the first switch means.

Meanwhile, a preferred embodiment of the invention is characterized in that the predetermined marginal period of time is taken approximately 1 ms.

In this embodiment, due to so-called a double-breakeffect, the power voltage (potential difference between the positive power source and the negative power source) can be shared, approximately half and half (approximately 21V on each in the case of a 42V-based electric system), by the first and second switch means. Accordingly, even in case the switch device under the specification of 14V-based electric system is used in the first switch means or second switch means, there is no possibility to cause dead-short.

DETAILED DESCRIPTION OF THE INVENTION

Now, embodiments of the present invention will be explained on the basis of the drawings.

Figure 1:
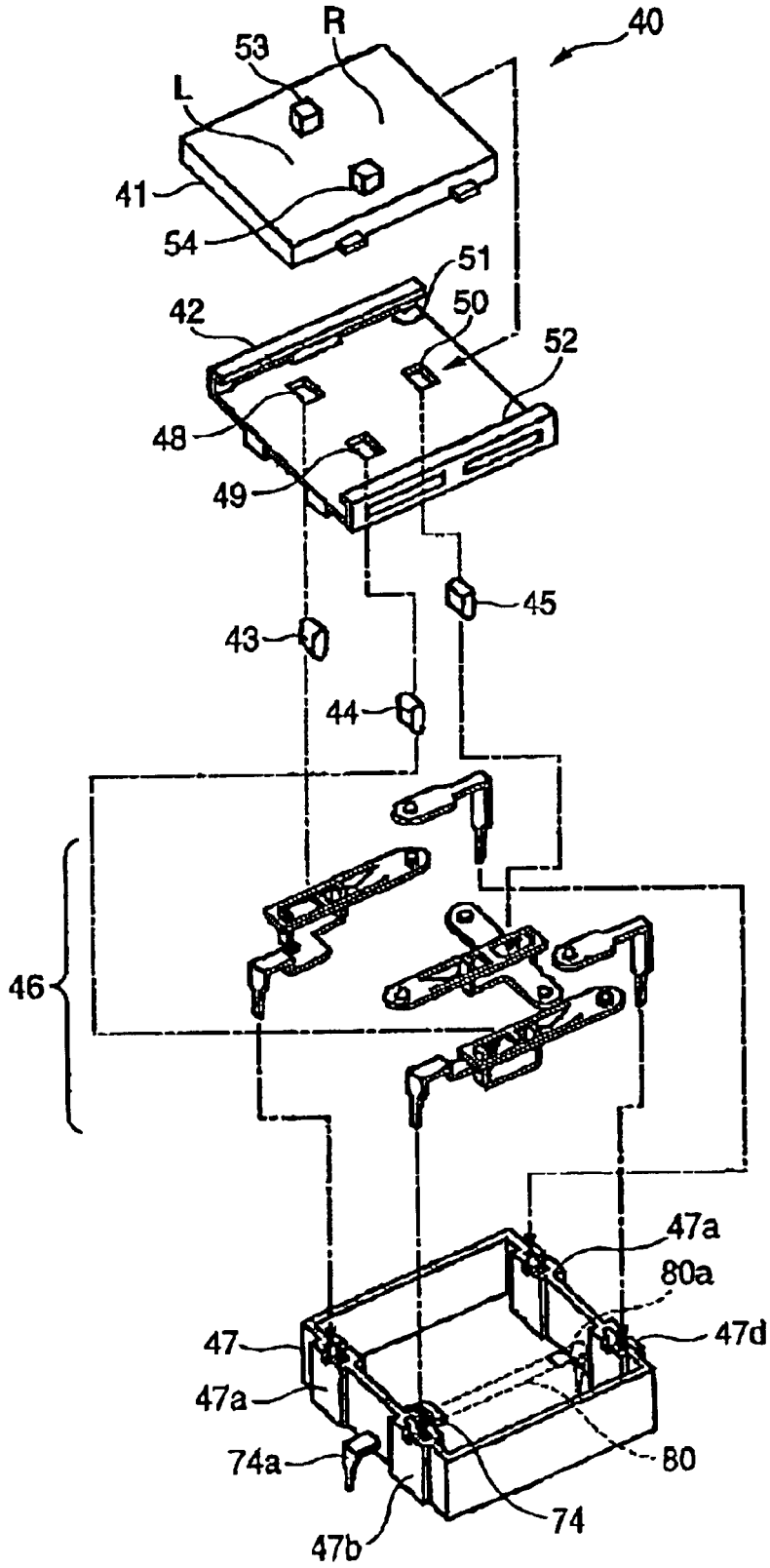
FIG. 1 is an exploded view of a switch device 40 in the present embodiment.

FIG. 1 is an exploded view of a switch device 40 of the present embodiment. The switch device 40 is structured by a slider (switch operating means) 41, a slide-railed upper lid (hereinafter, referred merely to as "upper lid") 42, three push buttons (switch operating means) 43 to 45, a contact mechanism group 46 in a snap-action type, and a housing 47, in the order from the upper of the figure. As for the switch device 40, after incorporating the contact mechanism group 46 made in a sub-assembly in the housing 47, the housing 47 is assembled by closing its upper opening with using the upper lid 42 assembled with the three push buttons 43 to 45 and a slider 41.

Figure 8A:
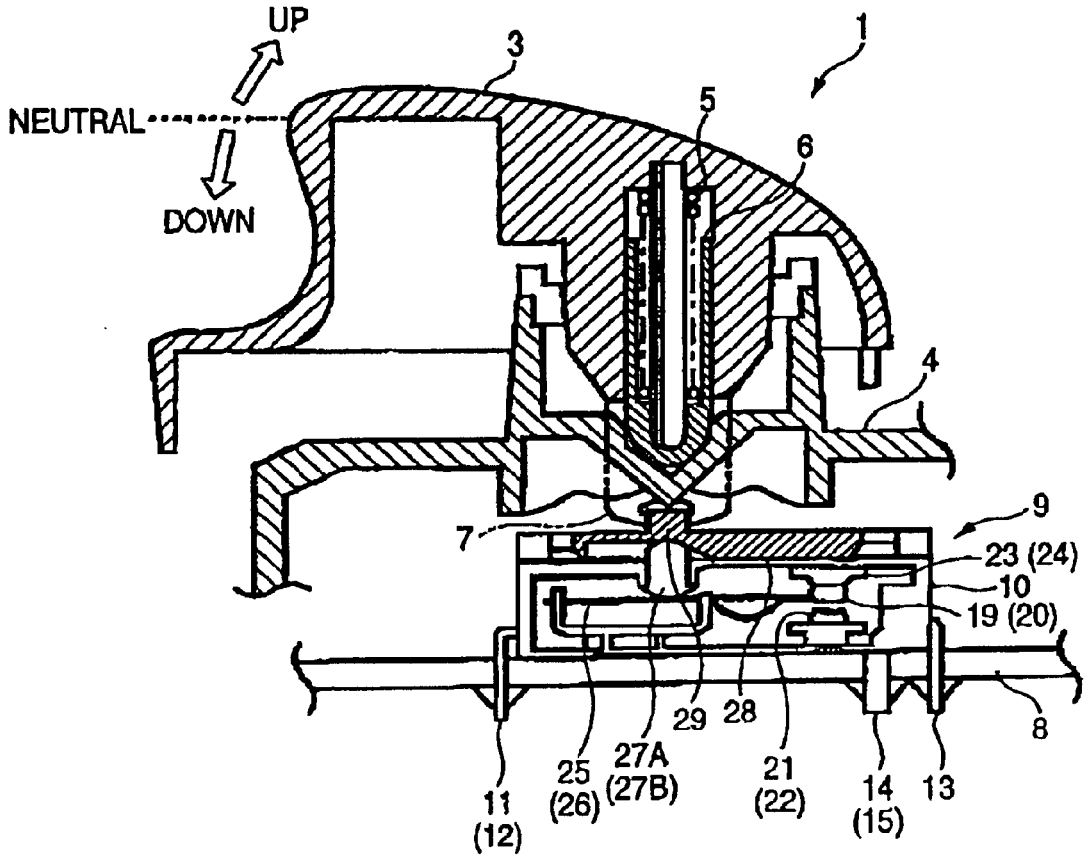
FIG. 8A is a structural view (in a neutral state) of a switch device of a prior art.
Figure 8B:
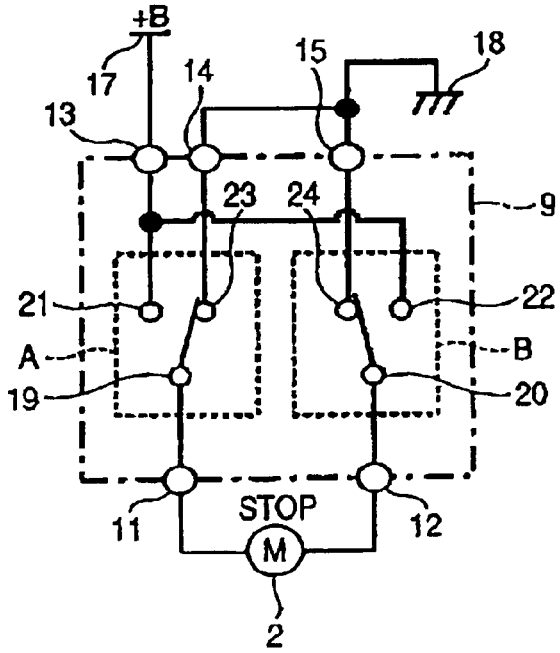
FIG. 8B is a circuit diagram (in a neutral state) of a switch device of a prior art.
Figure 9A:
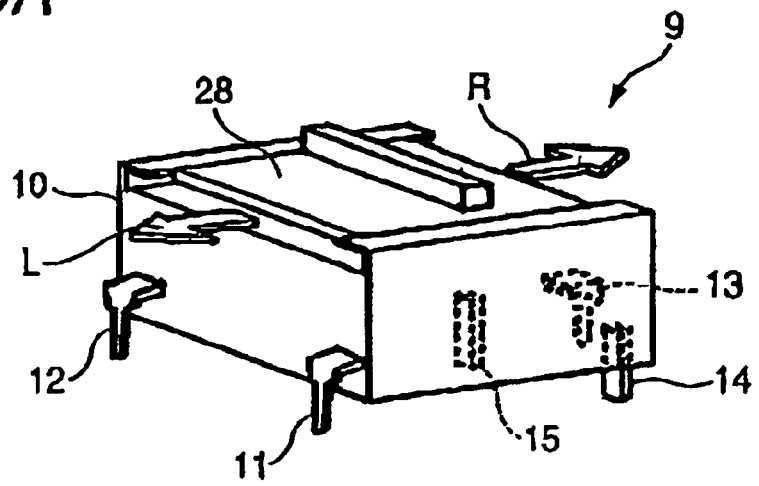
FIG. 9A is an external view of a switch unit 9.
Figure 9B:
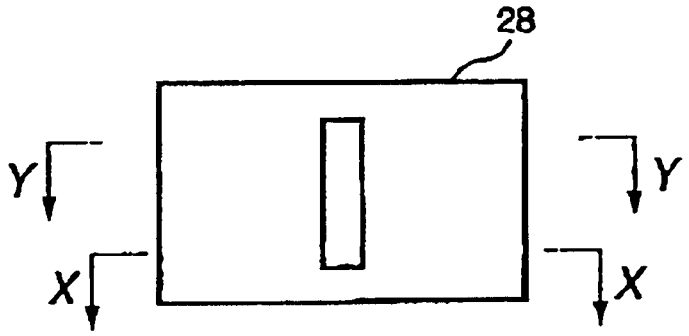
FIG. 9B is a plane view of a slider 28.
Figure 9C:
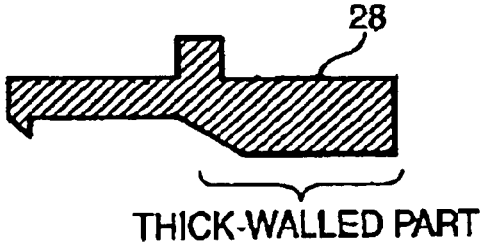
FIG. 9C and FIG. 9D are sectional views of the slider 28.
Figure 9D:
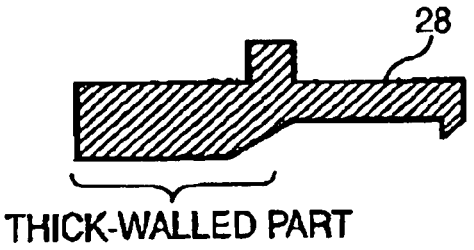
Figure 10A:
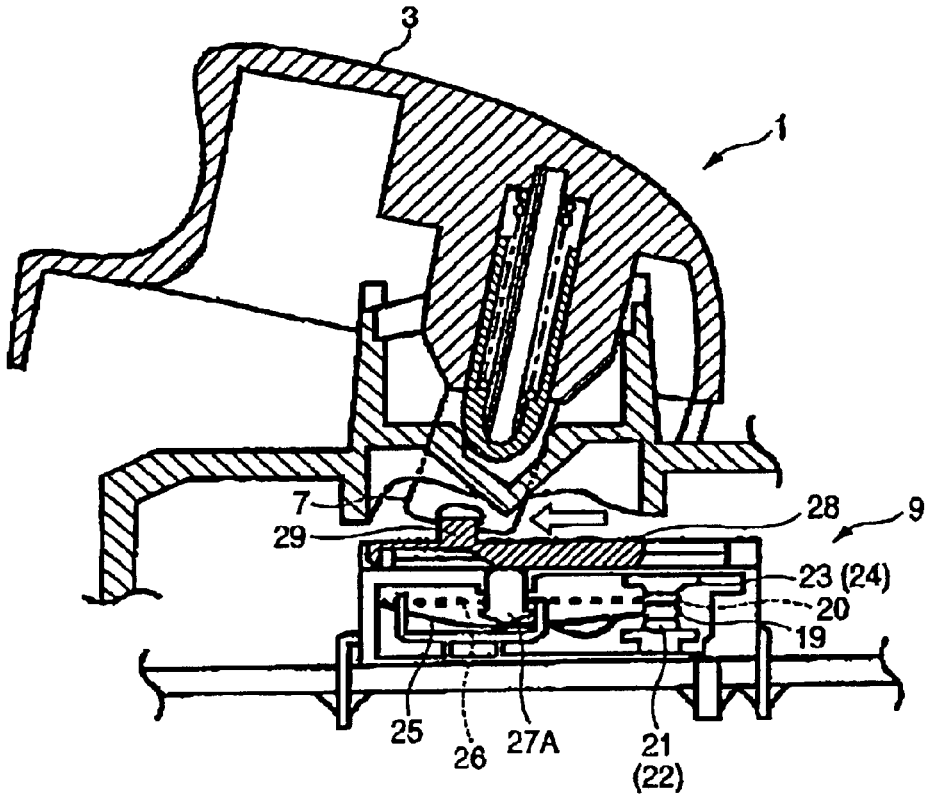
FIG. 10 A is a structural view (in an UP state) of the switch device of the prior art.
FIG. 10B is a circuit diagram (in an UP state) of the switch device of the prior art.
Figure 10B:
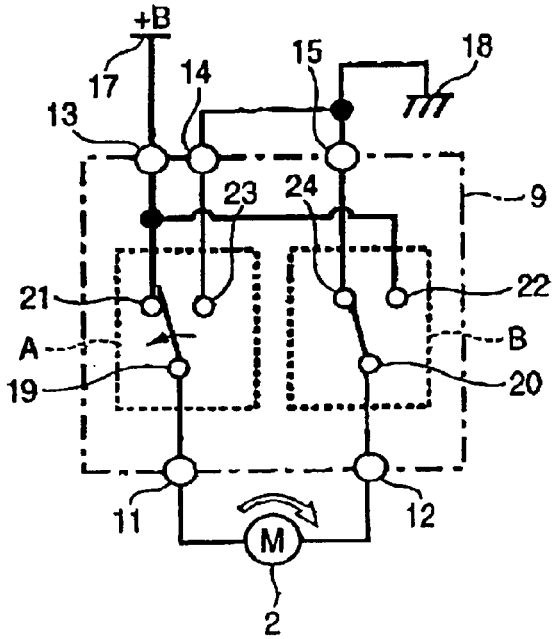
Figure 11:
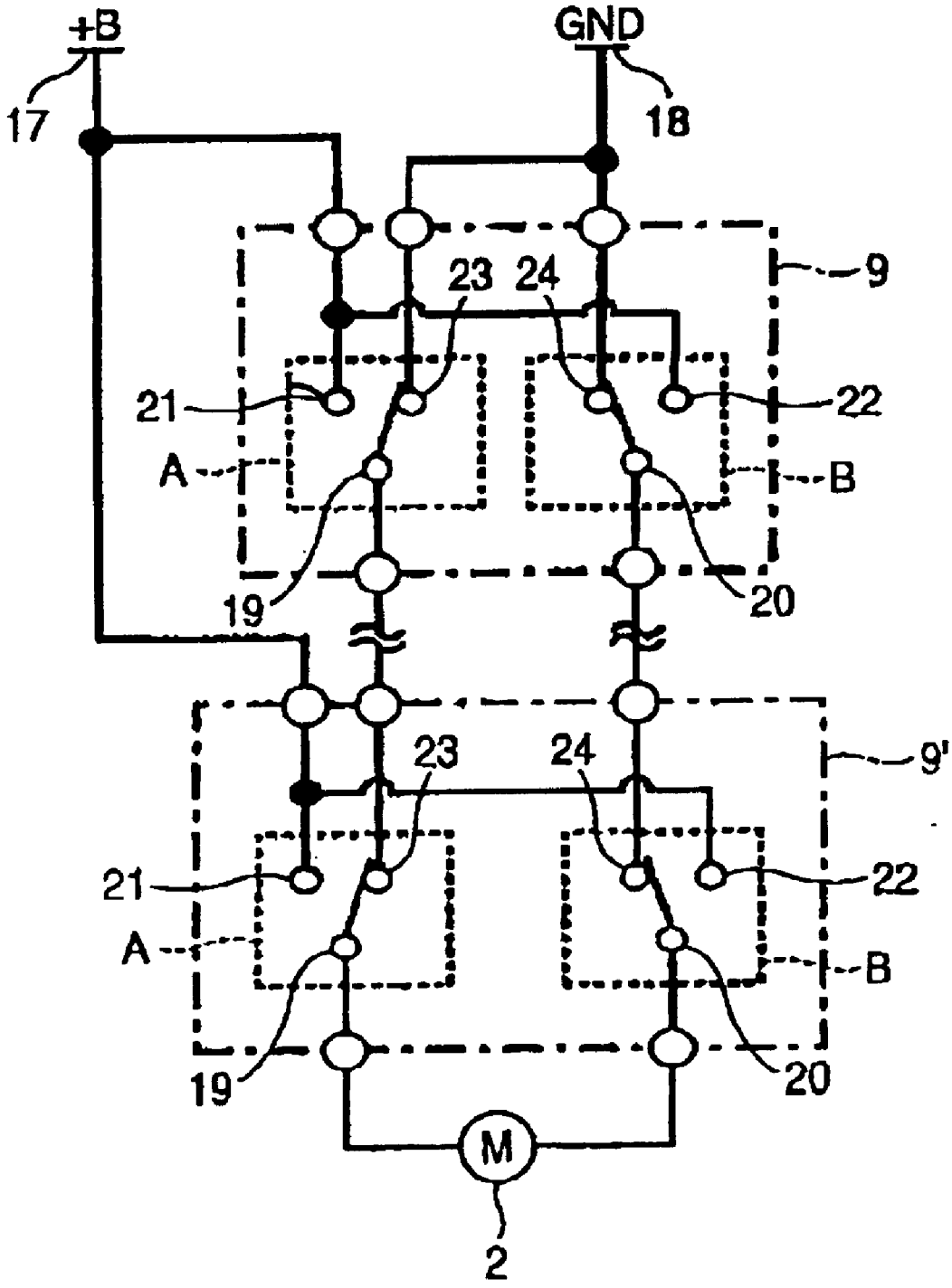
FIG. 11 is a circuit diagram showing a switch device in a type for operation, at the driver's seat, to open and close a window of other seat.
Figure 12:
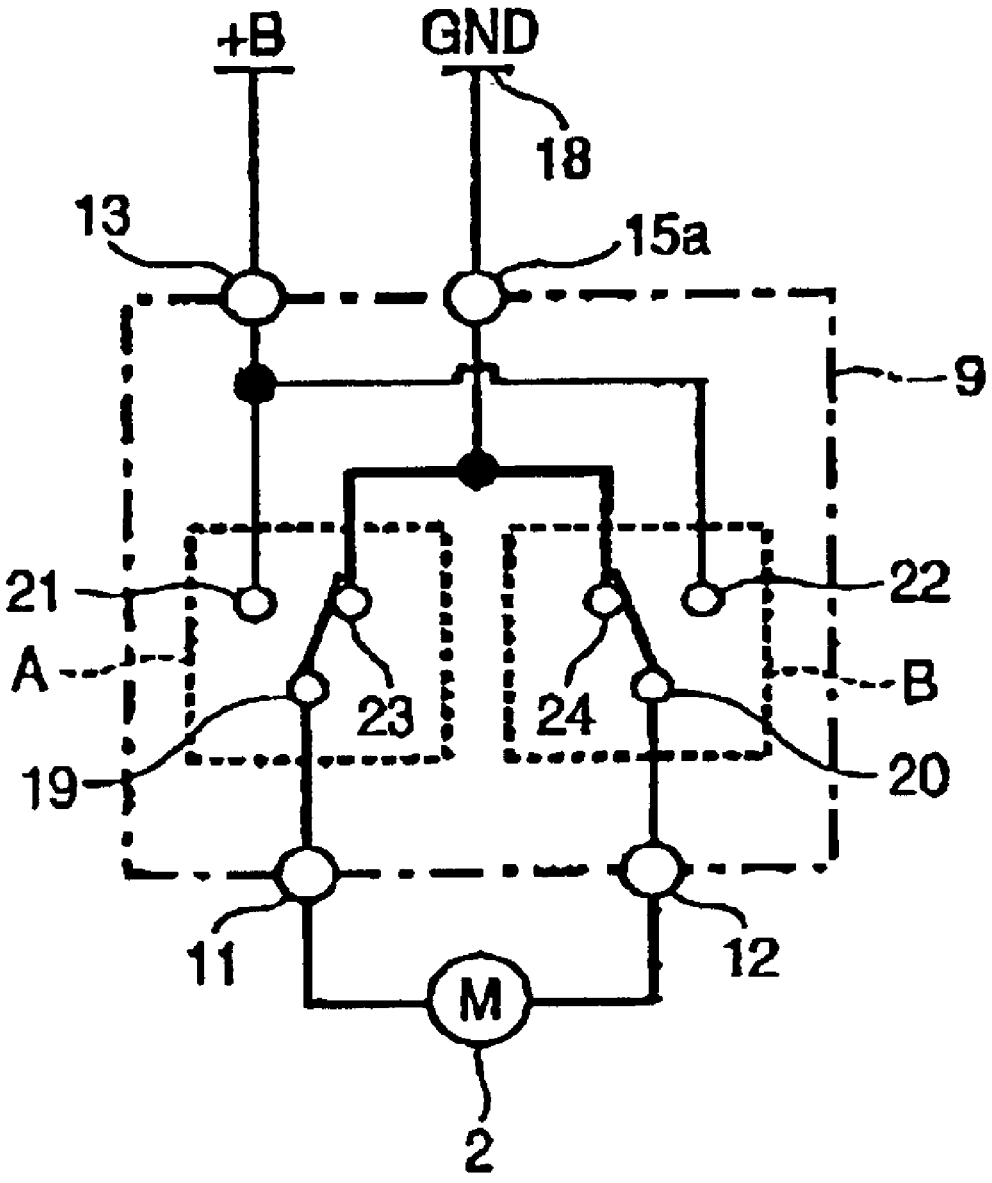
FIG. 12 is a circuit diagram of a switch device having four terminals in total.
Figure 13A:
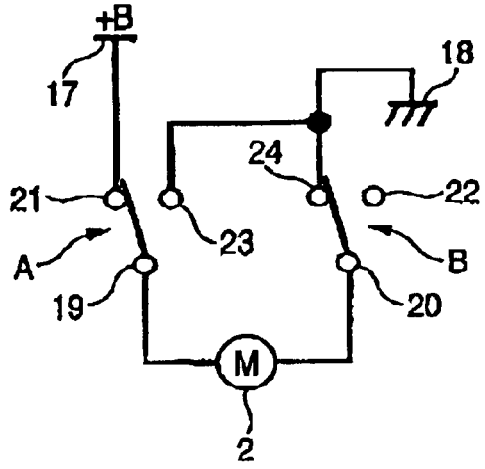
FIG. 13A to FIG. 13C are explanatory views of contact damage of the prior art.
Figure 13B:
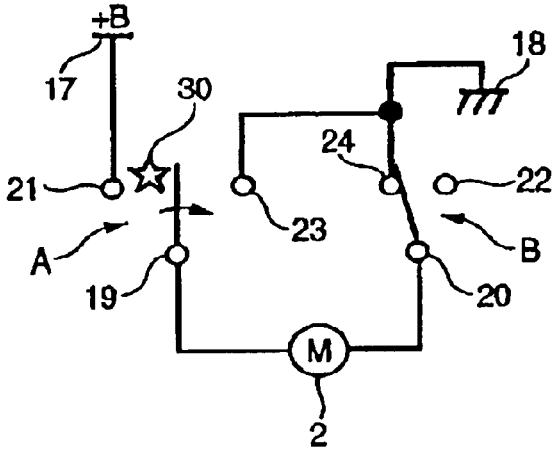
Figure 13C:
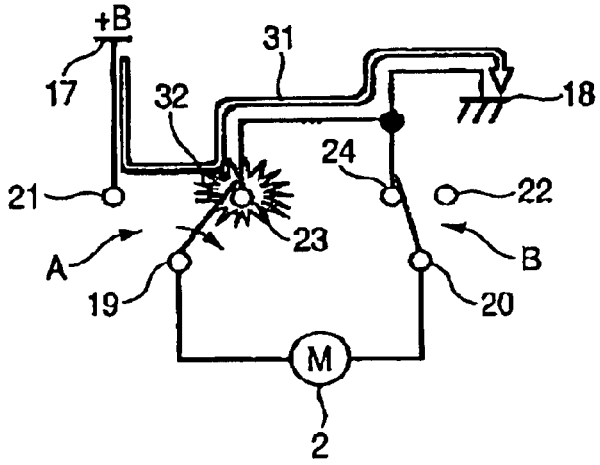

The upper lid 42 has insertion holes 48 to 50 for the push buttons 43 to 45 and slide rails 51, 52 holding the slider 41 for slide in L and R directions of the figure. The slider 41 has, on its upper surface, projections 53, 54 which correspond to the upper projection 29 of the slider 28 in the prior art (see FIG. 8). The projections 53. 54 are engageable with a tip of a lower projection 7 of the knob 3 shown for example in FIG. 8A. Thus, the slider 41 follows the lower projection 7 of the knob 3 swinging left and right (up and down states), to slide in the left/right direction (in the L/R direction). The slider 41 has a lower surface formed with a "peculiar shaped part" corresponding to the three push buttons 43 to 45.

Figure 2A:
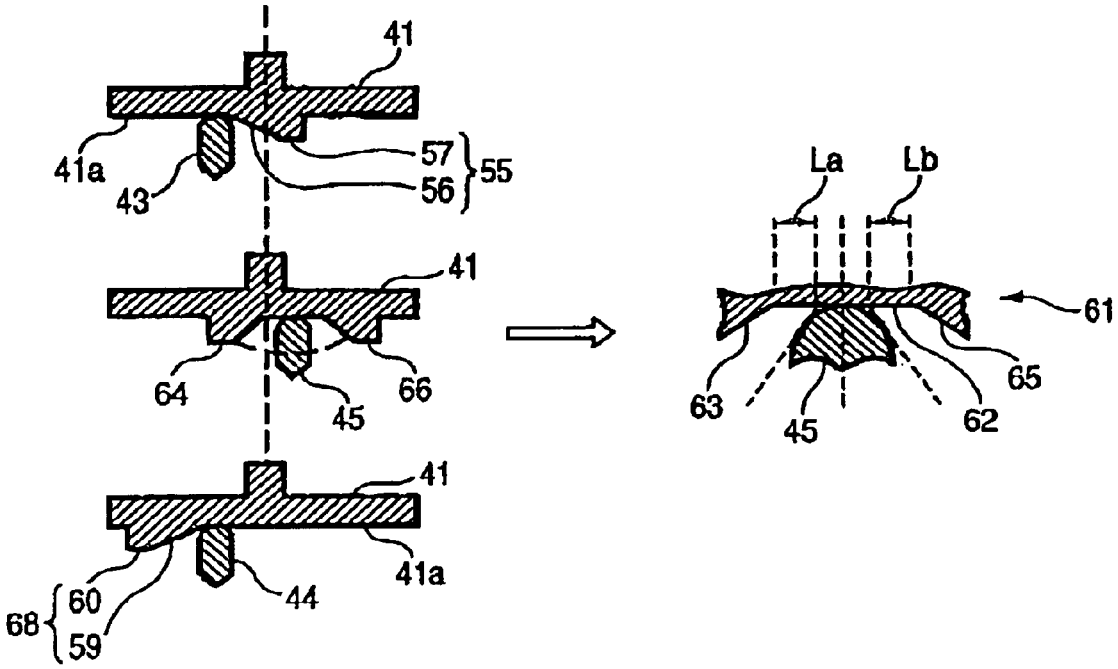
FIG. 2A to FIG. 2C are sectional views showing a peculiar shaped part of a slider 41.
Figure 2B:
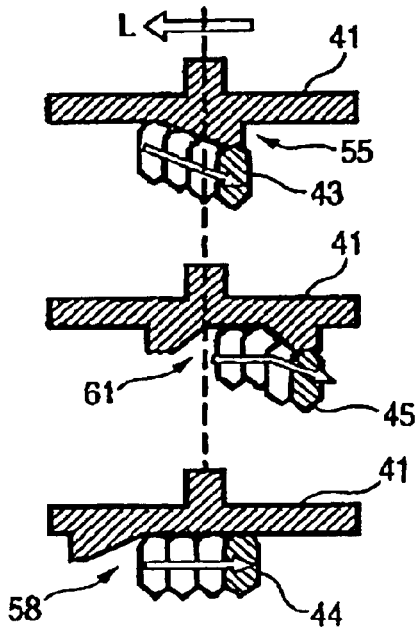
Figure 2C:
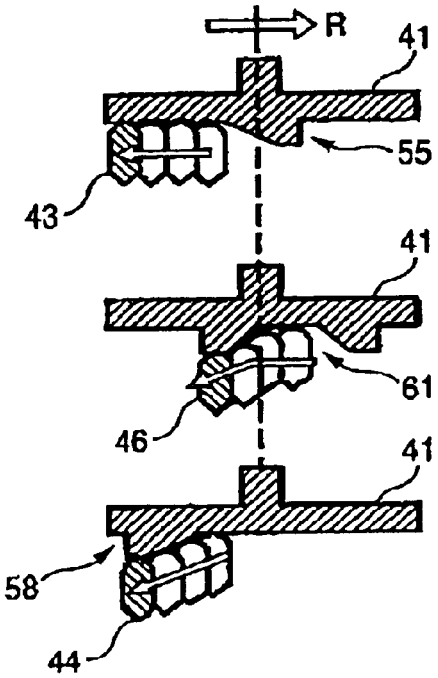

FIGS. 2A to 2C are sectional views showing the peculiar shaped part on the slider 41. In FIG. 2A, a first peculiar shaped part 55 has a slant surface 56, directed toward the lower right of the figure to press down the push button 43, and a flat surface 57 continuing therefrom. When the slider 41 is in a neutral state, the push button is an abutment against the lower surface 41*a* of the slider 41 in slid in the L direction as shown FIG. 2B, the push button 43 is gradually pushed downward of the figure while being abutted against surface 56 of the first peculiar shaped part 55, finally 55, finally reaching an abutment position (lowermost positon) against the flat surface 57.

Likewise, in FIG. 2A, a second peculiar shaped part 58 has a slant surface 59, directed toward the lower left of the figure to press down the push button 44, and a flat surface 60 continuing therefrom. When the slider 41 is in the neutral state, the push button 44 is in abutment against the lower surface 41*a* of the slider 41 thus assuming an uppermost position. In case the slider 41 is slid in the R direction as shown in FIG. 2C, the push button 44 is gradually pushed downward of the figure while being abutted against the slant surface 59 of the second peculiar shaped part 58, finally reaching an abutment position (lowermost position) against the flat surface 60.

In FIG. 2A. a third peculiar shaped part 61 has a form different from the above two peculiar shaped parts (first peculiar shaped part 55 and second peculiar shaped part 58). Namely, as shown in the magnifying view of FIG. 2A, the difference lies in that there are provided a neutral abutment surface 62 against which the push button 45 abuts when the slider 41 is in the neutral position and lying in the same level as the lower surface 41*a* of the slider 41, a slant surface 63 formed on the left side of the neutral abutment surface 62 and directed toward the lower left of the figure, a flat surface 64 continuing from the slant surface 63, a slant surface 65 formed on the right side of the neutral abutment surface 62 and directed toward the lower right of the figure, and a flat surface 66 continuing from the slant surface 65, in that a predetermined marginal distance La, Lb is provided between a nearly intermediate point (the intermediate point means an abutment point against which the push button 45 is in abutment when the slider 41 is in the neutral state) of the neutral abutment surface 62 and each slant surface 63, 65, and in that the slant surface 63, 65 has a slant angle set with greater steepness than the slant surfaces 56, 59 of the two peculiar shaped parts (first peculiar shaped part 55 and second peculiar shaped part 58).

With this structure, when the slider 41 is in the neutral state, the push button 45 abuts against the neutral abutment surface 62 and assumes the uppermost position. However, in case the slider 41 is slid in the L direction as shown in FIG. 2B, the push button 45 when exceeding the marginal distance La is gradually pressed downward of the figure while being abutted against the slant surface 63, finally reaching an abutment position (lowermost position) against the flat surface 64. Otherwise, in case the slider 41 is slid in the R direction as shown in FIG. 2C, the push button 45 when exceeding the marginal distance Lb is gradually pressed downward of the figure while being abutted against the slant surface 65, finally reaching an abutment position (lowermost position) against the flat surface 66.

In the case of returning the slider 41 to the neutral position, the steep angle of the slant surface 63, 65 causes it to reach the neutral abutment surface 62 in an earlier stage than the push buttons 43, 44 corresponding to the two peculiar shaped parts (first peculiar shaped part 55 and second peculiar shaped part 58), thus returning to the uppermost position in early timing. Hereinafter, the time corresponding to the "early stage" is referred to as a "predetermined marginal period of time" for convenience sake.

Figure 3:
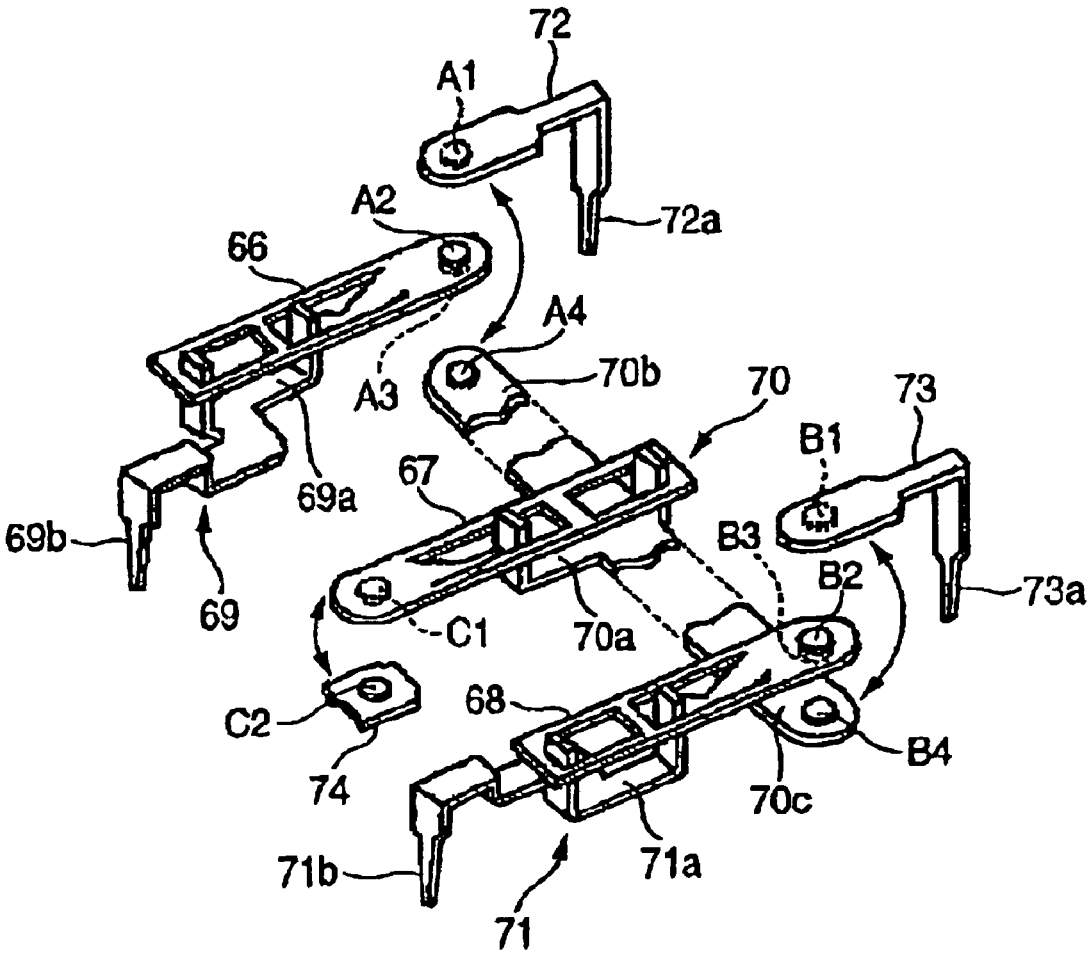
FIG. 3 is a view showing a structure of a contact mechanism group 46.

Consequently, according to this structure, there is provided the operation that, in case the slider 41 is slid in the L direction, the push button 43 immediately starts a downward movement and reaches the lowermost position upon completion of slide while the push button 45, after elapsing a predetermined marginal period of time, starts a downward movement and reaches the lowermost position upon completion of slide. Likewise, there is provided the operation that, in case the slider 41 is slid in the R direction, the push button 44 immediately starts downward movement and reaches the lowermost position upon completion of slide while the push button 45 after elapsing a predetermined marginal period of time starts downward movement and reaches the lowermost position upon completion of slide. Furthermore, there is provided the operation that, when returning the slider 41 to the neutral state, the push button 45 corresponding to the third peculiar shaped part 61 can be returned to the uppermost position earlier (i.e. before the predetermined marginal period of time) than the other two push buttons 43, FIG. 3 is a view showing a structure of the contact mechanism group 46. The contact mechanism 46 has three metal-make spring-leafed movable places (hereinafter, referred merely to as "movable places") 66 to 68, common terminal members 69 to 71 respectively for the movable pieces, two normally-close contact terminal members 72, 73, and one normally-open contact terminal member 74.

The three common terminal members 69 to 71, made of good conductive material such as metal, respectively have U-formed parts 69*a* to 71*a* to separately hold the movable pieces 66 to 68. The common terminal members 69, 71 at the both ends further have terminals 69*b*. 71*b* to be fitted to terminal engaging parts 47*a*, 47*b* (see FIG. 1) of the housing 47. Meanwhile, the common terminal member 70 at the center further has extending parts 70*b*. 70*c* extending toward the both-ended common terminal members 69, 71.

The two normally-close contact terminal members 72, 73 have respective terminals 72*a*, 73*a* to be fitted to terminal engaging parts 47*c*, 47*d* (see FIG. 1) of the housing 47. Meanwhile, the one normally-open contact member 74 has terminals 74*a*, 80*a* to be extended outward of the housing 47.

The three movable places 66 to 68, made of good conductive and springy material such as metal, have the following listed contacts at the respective tip ends thereof. Incidentally, concerning the "main surface/back surface" in the below explanation, the side to be seen on the figure is taken a "main surface" while the side invisibly hidden by a part is taken a "back surfaces".

(1) on main surface of movable piece 66→contact A2

(2) on back surface of movable piece 66→contact A3

(3) on back surface of movable piece 67→contact C1

(4) on main surface of movable piece 68→contact B2

(5) on back surface of movable piece 68→contact B3

Meanwhile, the contacts listed in the following are attached on the extended parts 70*b*, 70*c* of the common terminal member 70.

(6) on main surface of extended part 70*b*→contact A4

(7) on back surface of extended part 70*c*→contact B4

Furthermore, the contacts listed in the following are attached on the two normally-close contact terminal members 72, 73 and one normally-open contact members 74.

(8) on back surface of normally-close contact terminal member 72 contact A1

(9) on back surface of normally-close contact terminal member 73 contact B1

(10) on main surface of normally-open contact member 74→contact C2

The three movable pieces 66 to 68 are elastically deformed by pressing down the push buttons 43 to 45 explained before, to switch over the connection at each contact.

Figure 4A:
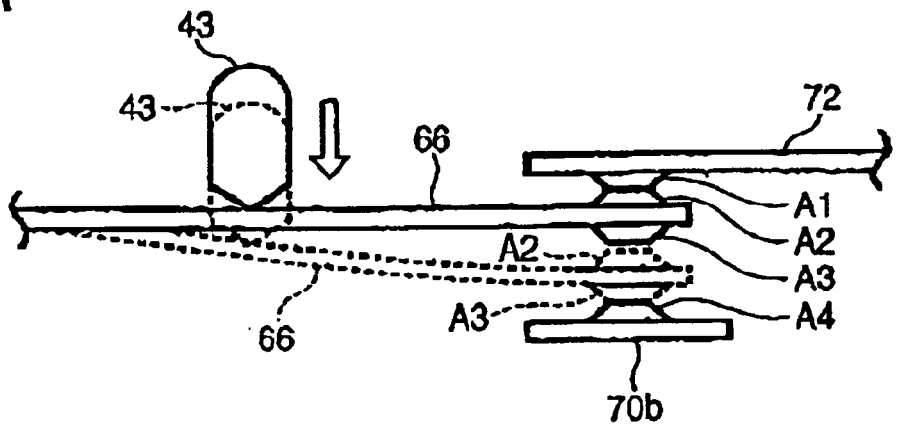
FIG. 4A to FIG. 4C are contact switching state views of three movable pieces 66 to 68.
Figure 4B:
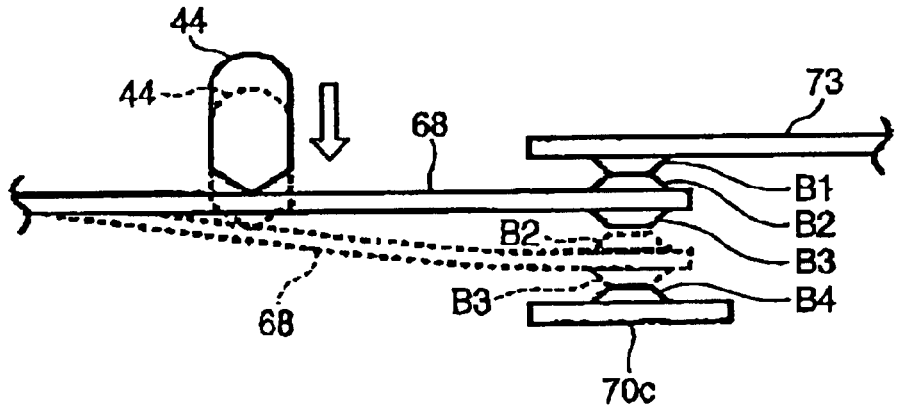
Figure 4C:
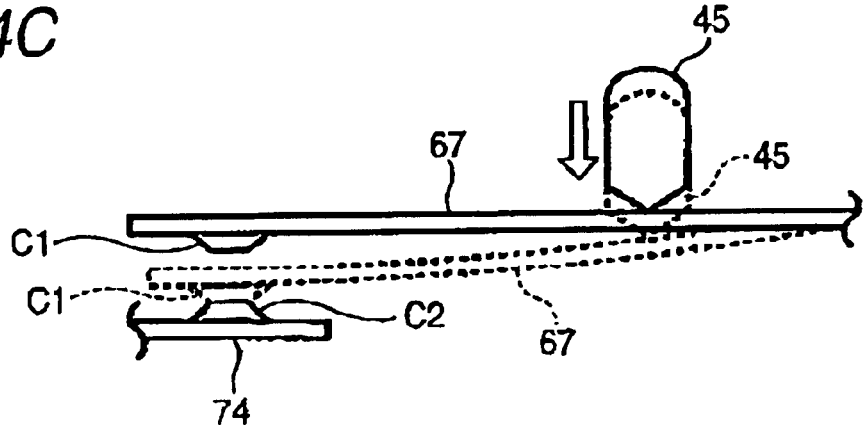

FIGS. 4A to 4C contact switching state views of the three movable pieces 66 to 68.

In FIG. 4A, the movable piece 66 usually closes between the contacts A1 and A2, leaving open between the contacts A3 and A4. However, if deformed responsive to pressing down the push button 43, this opens between the contacts A1 and A2, to close between the contacts A3 and A4.

In FIG. 4B, the movable piece 68 usually closes between the contacts B1 and B2, leaving open between the contacts B3 and B4. However. If deformed responsive to pressing down the push button 44, this opens between the contacts B1 and B2, to close between the contacts B3 and B4.

In FIG. 4C, the movable piece 67 usually opens between the contacts C1 and C2, However, if deformed responsive to pressing down the push button 45, this closes between the contacts C1 and C2.

Accordingly, the contact mechanism group 46 including these contacts A1 to A4, B1 to B4, C1 and C2 can be divided into the following switch element groups.

<First: Those Structured by Contacts A1 to A4>

The contact A1 and the contact A2 structure a normally-close contact (NC) while the contact A3 and the contact A4 structure a normally-open contact (NO). The relationship of contacts is inverted by pressing down the push button 43.

<Second: Those Structured by Contacts B1 to B4>

The contact B1 and the contact B2 structure a normally-close contact (NC) while the contact B3 and the contact B4 structure a normally-open contact (NO). The relationship of contacts is inverted by pressing down the push button 44.

<Third: Those Structured by Contacts C1, C2>

The contact C1 and the contact C2 structure a normally-open contact (NO). This contact is placed into a closed state by pressing down the push button 45.

Figure 5:
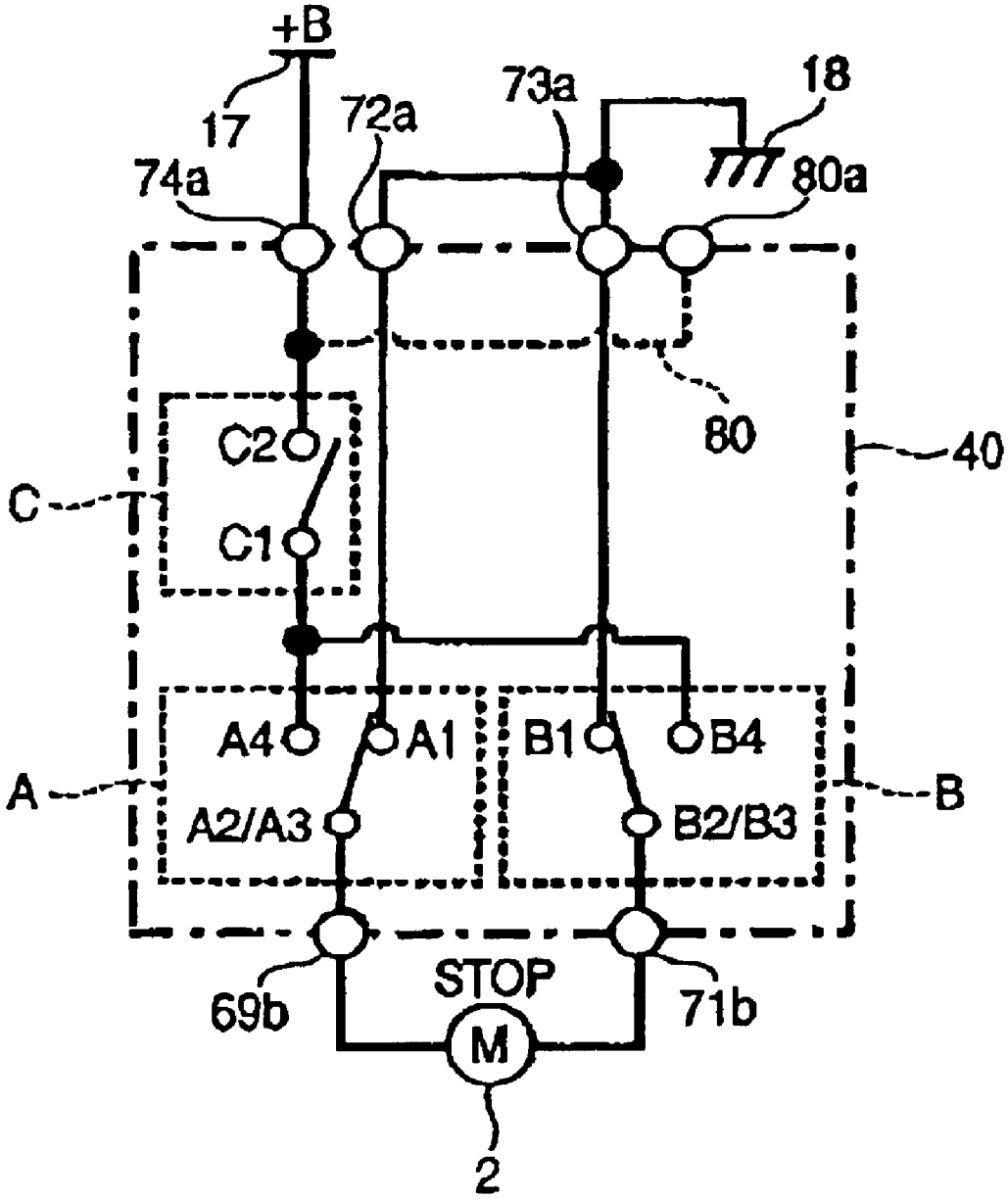
FIG. 5 is a circuit diagram of a switch device 40 in the present embodiment.

FIG. 5 is a circuit diagram of the switch device 40 having the above structure. Although not especially limited, the switch device 40 is used to rotate and stop a window-opening/closing direct-current motor.

The switch device 40 includes three switches A to C corresponding to the respective ones of the foregoing switch element groups (first to third). The switch A comprises the foregoing contacts A1 to A4, the switch B comprises the foregoing contacts B1 to B4, and further the switch C comprises the foregoing contacts C1 and C2.

As shown in the figure, electrical connection is provided between the contact C1 of switch C, the contact A4 of switch A and the contact B4 of switch B. Meanwhile, the contact C2 of switch C is connected to a positive power source (potential on +B line 17, +42 V) through a terminal 74*a*. The contact A1 of switch A and the contact B1 of switch B are connected to a negative power source (potential on ground line 18: 0 V) through terminals 72*a*, 73*a*. Furthermore, the contact A2/A3 of switch A and the contact B2/B3 of switch B are connected to the respective inputs of a direct-current motor 2 through terminals 69*b*, 71*b*.

Incidentally, the line 80 drawn from between the contact C2 of switch C and the terminal 74*a* is a wiring for connection to a spare terminal 80*a*. The spare terminal 80*a* is attached on an opposite side surface to the extension terminal (terminal 74*a* for the contact C2) provided on the housing 47, as shown in FIG. 1. When mounting the switch device 40, in the case the extension terminal (terminal 74*a*) for the contact C2 of switch C cannot be used because of wiring convenience or interference with other parts, the use of the spare terminal 80*a* makes it possible to extend the contact C2 of switch C to the outside or to use the terminals 74*a* and 80*a* as a jumper wire.

In FIG. 5, the contact positions of switches A, B, C shown in the figure are in a state the push button 43 to 45 is not pressed down (when the slider 41 is in the neutral state; see FIG. 2A). In this state, negative power is applied to one drive input of the direct-current motor 2 through the route of ground line 18→terminal 72*a*→contact A1 of switch A→contact A2 of switch A→terminal 69*b*, while negative power is applied to the other drive input of the direct-current motor 2 through the route of ground line 18→terminal 73*a*→contact B1 of switch B→contact B2 of switch B→terminal 71*b*. In this case, the direct-current motor 2 is in a stop state.

Meanwhile, in the case the slider 41 is moved in the L direction (see FIG. 2B), the push button 43, 45 moves downward to thereby close between the contacts A3 and A4 of switch A as well as between the contacts C1 and C2 of switch C. Consequently, positive power is applied to one drive input of the direct-current motor 2 via the route of +B line 17→terminal 74*a*→contact C2 of switch C→contact C1 of switch C→contact A4 of switch A→contact A3 of switch A→terminal 69*b*, while negative power is applied to the other drive input of the direct-current motor 2 via the route of ground line 18→terminal 73*a*→contact B1 of switch B→contact B2 of switch B→terminal 71*b*. In this case, the direct-current motor 2 rotates forward to drive the window in a closing direction.

Meanwhile, in the case the slider 41 is moved in the R direction (see FIG. 2C), the push button 44, 45 moves downward to thereby close between the contacts 83 and B4 of switch B as well as between the contacts C1 and C2 of switch C. Consequently, positive power is applied to the other drive input of the direct-current motor 2 via the route of +B line 17→terminal 74*a*→contact C2 of switch C→contact C1 of switch C contact B4 of switch B→contact B3 of switch B→terminal 71*b*, while negative power is applied to the one drive input of the direct-current motor 2 via the route of ground line 18→terminal 72*a*→contact A1 of switch A→contact A2 of switch A→terminal 69*b*. In this case, the direct-current motor 2 rotates reverse to drive the window in an opening direction.

Herein, the contacts C1 and C2 of switch C are normally-open contacts, Namely, these are to close the contacts responsive to pressing down the push button 45, which are constituent elements unique to the invention, However, assumed is the case for explanation convenience that this switch C is not provided . . . i.e. direct connection is assumably made between the terminal 74*a* and the contact A4 of switch A and contact B4 of switch B. In this case, the switches A and B can take a "motor stop status to apply negative power to both of one drive input and the other drive input of the direct-current motor 2 thereby placing the direct-current motor 2 in a stop state", a "motor forward rotation status to apply positive power to one drive input of the direct-current motor 2 and negative power to the other drive input thereby placing the direct-current motor 2 in a forward rotation state", and a "motor reverse rotation status to apply negative power to one drive input of the direct-current motor 2 and positive power to the other drive input thereby placing the direct-current motor 2 in a reverse rotation state". Thus, the switches A and B constitute first switch means described in the gist of the invention.

The switch C, element unique to this embodiment, "is to electrically connect and disconnect between the first switch means (switches A and B) and the positive or negative power source and between one or the other drive input of the direct-currant motor 2", hence constituting second switch means described in the gist of the invention.

Figures 6A, 6B:
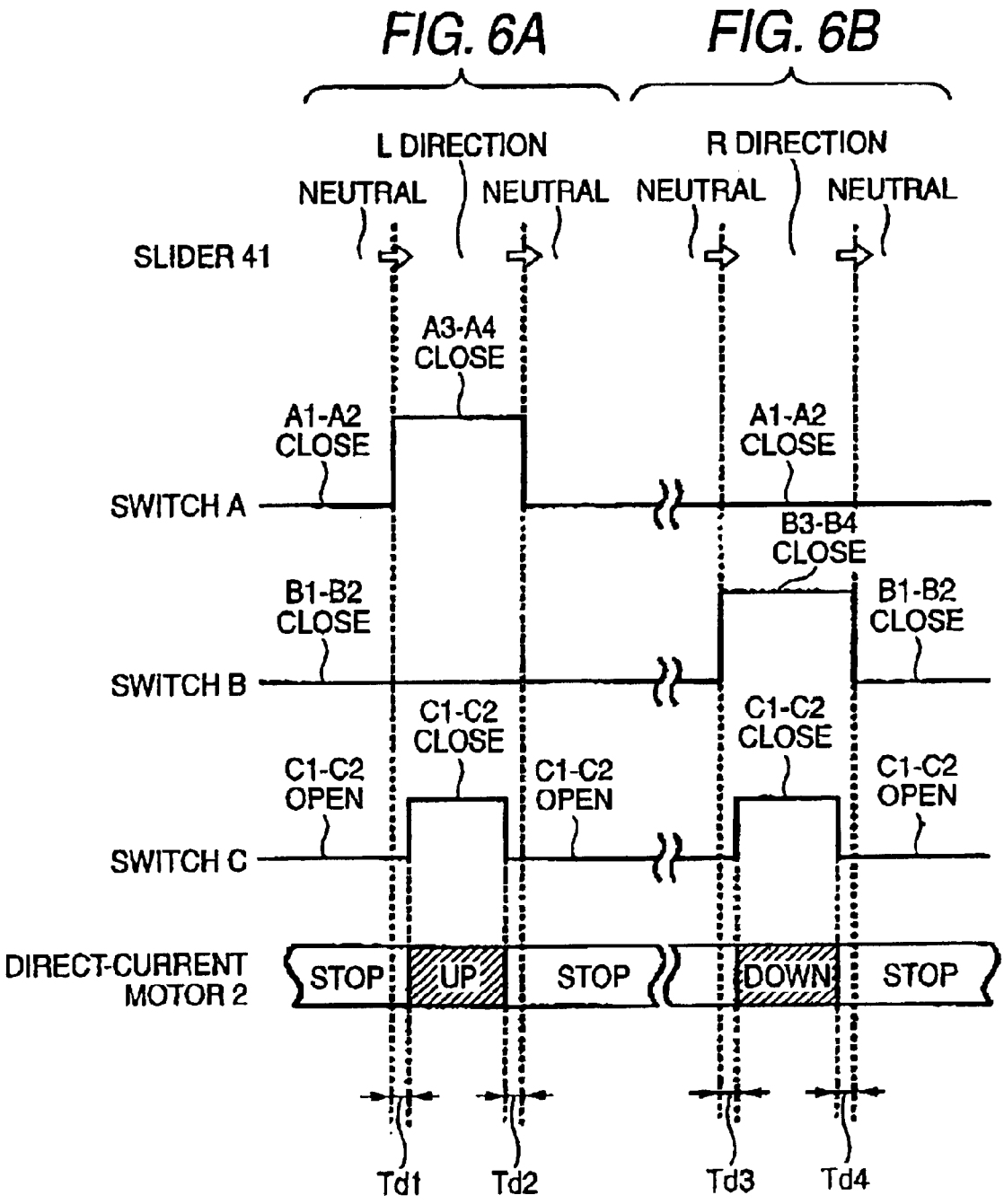
FIG. 6A and FIG. 6B are status corresponding charts of a between a contact switching operation of the switch A, B, C and a stop/rotation operation of the direct-current motor 2.

FIGS. 6A and 6B are is a state corresponding diagrams of between a contact-changeover operation of the switch A, B, C, and a stop/rotation operation of the direct-current motor 2. More specifically, FIG. 6A is a state diagram wherein the slider 41 is moved in the L direction from the neutral state and again returned to the neutral state, while FIG. 6B is a state diagram wherein the slider 41 is moved in the R direction from the neutral state and again returned to the neutral.

In FIG. 6A, when the slider 41 is in the neutral state, the switch A is closed at its contacts A1 and A2. Meanwhile, because the switch B is closed at its contacts B1 and B2 and further the switch C is open at its contacts CL and C2, the direct-current motor 2 is in a stop (STOP) state.

In case the slider 41 in this state is moved in the L direction, the push button 43 first moves downward and then the push button 45 moves downward with a delay of predetermined marginal period of time (Td1). Due to this, the switch A is closed at its contacts A3 and A4 (opened at its contacts A1 and A2), and the switch C is closed at its contacts C1 and C2 with a delay of predetermined marginal period of time (Td1), thus rotating the direct-current motor 2 forward (UP).

In case the slider 41 is returned to the neutral state, the push button 45 first moves upward and then the push button 43 moves upward with a delay of predetermined marginal period of time(Td2). Due to this, the switch C is opened at its contacts C1 and C2, and the switch A is closed at its contacts A1 and A2 with a delay of predetermined marginal period of time (Td2) (opened at its contacts A3 and A4), again stopping (STOP) the direct-current motor 2.

In FIG. 6B, when the slider 41 is in the neutral state, the switch A is closed at its contacts A1 and A2. Meanwhile, because the switch B is closed at its contacts B1 and B2 and further the switch C is open at its contacts C1 and C2, the direct-current motor 2 is in a stop (STOP) state.

In case the slider 41 in this state is moved in the R direction, the push button 44 first moves downward and then the push button 45 moves downward with a delay of predetermined marginal period of time (Td3). Due to this, because the switch C is closed at its contacts C1 and C2 with a delay of predetermined marginal period of time (Td3), the direct-current motor 2 rotates reverse (DOWN).

In case the slider 41 is returned to the neutral state, the push button 45 first moves upward and then the push button 44 moves upward with a delay of predetermined marginal period of time (Td4). Due to this, the switch C is opened at its contacts C1 and C2, and the switch B is closed at its contacts B1 and B2 with a delay of predetermined marginal period of time (Td4) (opened at its contacts B3 and B4), again stopping (STOP) the direct-current motor 2.

Herein the marginal period of time Td1, Td2, Td3, and Td4 in the figure is a time period given by a marginal distance La, Lb of the third peculiar shaped part 61 (see FIGS. 2A to 2C) formed in the underside of the slider 41 and a slant angle of the slant surface 63, 65. Specifically, the marginal period of time Td1, Td2 is a time period given by a length of a marginal distance 1*b* of the third peculiar shaped part 61 and a slant angle of the slant surface 65. Likewise, the marginal period of time Td3, Td4 is a time period given by a length of marginal distance La of the third peculiar shaped part 61 and a slant angle of the slant surface 63. For the both, the marginal period of time can increased by increasing the marginal distance and making the slant angle more steep. The marginal period of time required in preventing dead-short is "Td2, Td4". The proper value of marginal period of time Td2, Td4 is dependent upon a contact gap and power voltage magnitude and not to be fixed definitely, but it can take approximately 1 ms, for example.

As described above, the witch device 40 of the present embodiment has a normally-open-contact switch C, and is characterized by providing a predetermined marginal period of time between a switching-over at the contact of switch A or B and a switching-over at the contact of switch C. By this characteristic, solved is the problem of dead-short as explained in the introduction.

Namely, dead-short takes place as discharge phenomenon at between the contact A3 (or B3) as a common contact of switch A (or switch B) and the contact A4 (or B4) as a fixed contact connected to the positive power source, when the direct-current motor 2 is returned from forward or reverse rotation to stop state. In this embodiment, before the switch A (or switch B) contacts (closes) at its contacts A2 (or B2) and A1 (or B1) (prior to a predetermined marginal period of time Td2 or Td4: e.g. approximately 1 ms before), the switch C is opened at its contacts C1 to C2 (operated from connection to disconnection state) to thereby shutting off the positive power route. Thus, this can prevent dead-short occurrence.

Incidentally, in the above explanation, although the predetermined marginal period of time Td2 or Td4 is a time period greater than 0 (approximately 1 ms in the foregoing exemplification), this is not limited to. Td2=Td4=0 ms may be provided where manufacturing variation such as contact gap is not to be taken account of. If doing so, the voltage at the contact of switch C and switch A (or switch B) is given nearly a half of the power voltage due to the double-break effect. In the case of a 42 V electrical system, each switch satisfactorily takes its share of nearly 21 V. With a voltage in this degree (21 V), the switch can cut off arcing without causing dead-short even under 14-V-based electrical system specification. The "double-break effect" is meant to enable high-voltage opening/closing without increasing contact gaps due to doubling the voltage of an arc to occur upon opening the contact.

Incidentally, the present invention is not limited to the above embodiment but includes various modifications within the scope of the idea.

Figure 7A:
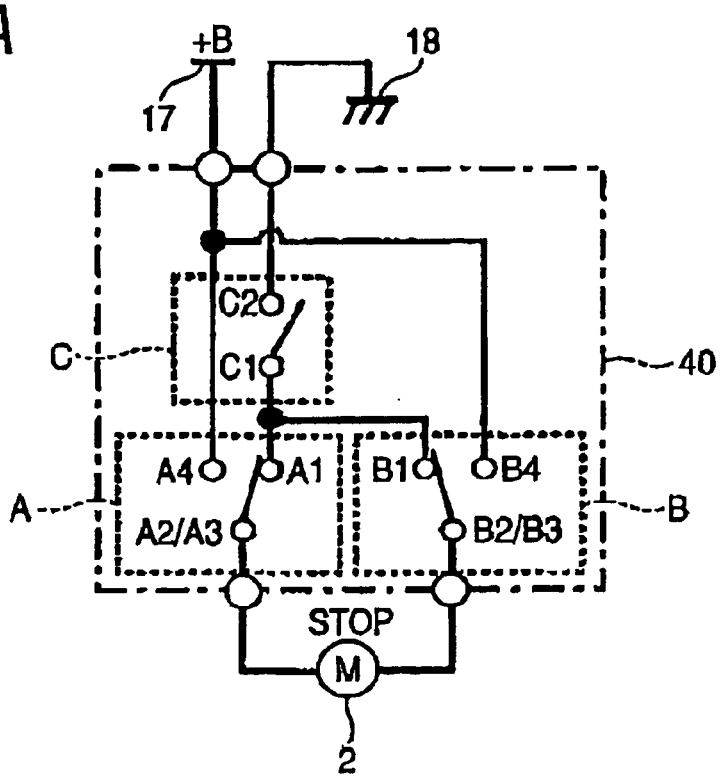
FIG. 7A and FIG. 7B are diagrams showing a modification of the switch device 40 of the present embodiment.

FIG. 7A is a diagram showing a first modification. The difference from the foregoing embodiment lies in an insertion position of the switch C (second switch means). Namely, this modification is different in that the switch C (second switch means) is provided between a contact A1 and B1 of a switch A and B (first switch means) and a ground line 18 (negative power source). In also this configuration, simultaneously with or prior to contacting (closure) between contacts A2 (or B2) and A1 (or B1) of switch A (or B) (prior to a predetermined marginal period of time Td2 or Td4), the switch C is opened at its contacts C1 to C2 to shut off the negative power route. This can prevent dead-short occurrence.

Figure 7B:
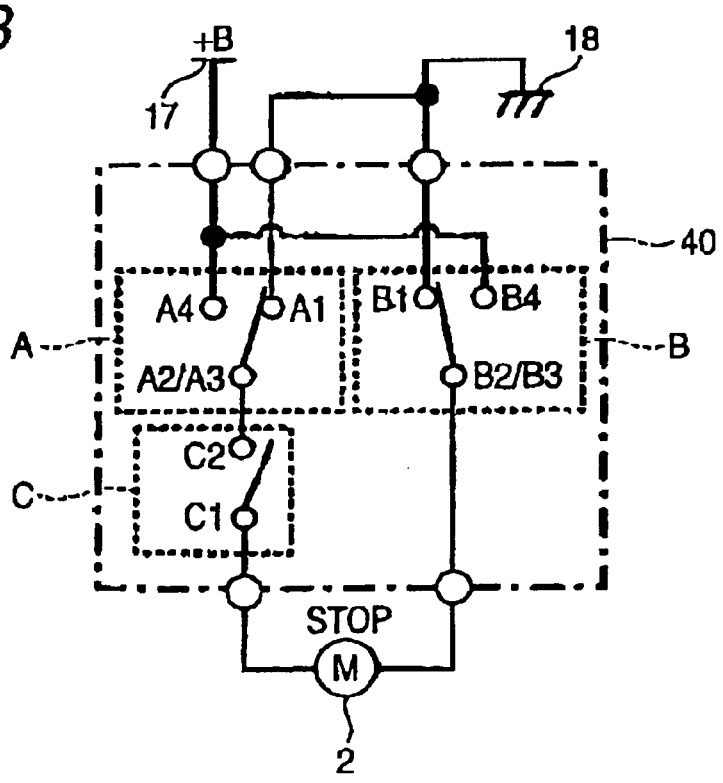

FIG. 7B is a diagram showing a second modification. In also this example, the difference from the foregoing embodiment configuration lies in an insertion position of the switch C (second switch means). Namely, this modification is different in that the switch C (second switch means) is provided between a contact A2/A3 of a switch A and one drive input of a direct-current motor 2. In also this configuration, simultaneously with or prior to contacting (closure) between contacts A2 and A1 switch A (prior to a predetermined marginal period of time Td2 or Td4), the switch C is opened at its contacts C1 to C2 to shut off the route to the direct current motor 2. This can prevent dead-short occurrence.

According to the present invention, the second switch means is operated from a connection state to a disconnection state at a time of any of completing the transition to the motor stop status and prior to a predetermined marginal period of time. Accordingly, during disconnection in the second switch means, electrical connection is cut off at any of between the first switch means and one of the positive power source and the negative power source and between the first switch means and one of one drive input of the direct-current motor and the other drive input thereof. Accordingly, the first switch means is reduced of the remaining voltage at the contact thereof, thereby eliminating the dead-short problem from the first switch means. Moreover, because the countermeasure against dead-short does not require to enlarge a contact gap, there is no possibility to incur a great size increase of the switch unit.

Meanwhile, according to a preferred embodiment of the invention, it is characterized in that the predetermined marginal period of time is taken approximately 1 ms. Due to so-called a double-break effect and time lag, the power voltage (potential difference between the positive power source and the negative power source) can be shared, approximately half and half (approximately) 21V on each in the case of a 42V-based electric system), by the first and second switch means. Moreover, should a power of several volts be applied to the movable piece, positive power is positively shut off by the time lag. Accordingly, even in case the switch device under the specification of 14V-based electric system is used in the first switch means or second switch means, there is no possibility to cause dead-short.

What is claimed is:

1. A switch device having a first switch means capable of taking a motor stop status for applying a negative power to each of one drive input and the other drive input of a direct-current motor thereby placing the direct-current motor in a stop state, a motor forward rotation status for applying a positive power to one drive input of the direct-current motor and a negative power to the other drive input thereof thereby placing the direct-current motor in a forward rotation state, and a motor reverse rotation status for applying a negative power to one drive input of the direct-current motor and a positive power to the other drive input thereof thereby placing the direct-current motor in a reverse rotation state, the switch device comprising:

second switch means for electrically connecting and disconnecting any of between the first switch means and one of the positive power and negative power and between the first switch means and one of one drive input and the other drive input of the direct current motor; and switch operating means for operating, upon transition of the first switch means from one of the motor forward rotation status and the motor reverse rotation status to the motor stop status, the second switch means from a connection state to a disconnection state at a time of any of completing the transition to the motor stop status and prior to a predetermined marginal period of time.

2. The switch device according to claim 1, the predetermined marginal period of time is taken approximately 1 ms.

* * * * *